US005172435A

United States Patent [19]

Griffin et al.

[11] Patent Number: 5,172,435

[45] Date of Patent: Dec. 22, 1992

[54] EXTEND-A-BED FOR INFANTS AND VERY YOUNG CHILDREN

[76] Inventors: Darlene Griffin; Peter Griffin, both of 608 Beaverkill Rd., Kingston, N.Y. 12401

[21] Appl. No.: 861,464

[22] Filed: Apr. 1, 1992

[51] Int. Cl.[5] ..... A47D 7/01; A47D 7/02; A47D 7/04

[52] U.S. Cl. ..... 5/95; 5/98.1; 5/99.1; 5/312

[58] Field of Search ..... 5/95, 96, 93.1, 93.2, 5/98.1, 99.1, 424, 312

[56] References Cited

U.S. PATENT DOCUMENTS

| | | | |
|---|---|---|---|
| 548,005 | 10/1895 | Miller, Jr. | 5/95 |
| 620,069 | 2/1899 | Cobb | 5/95 |
| 1,138,451 | 5/1915 | Bugele | 5/95 |
| 1,200,830 | 10/1916 | Goss | 5/95 |
| 1,267,244 | 5/1918 | McMillan | 5/95 |
| 1,283,169 | 10/1918 | Hasson | 5/95 |

FOREIGN PATENT DOCUMENTS

| | | | |
|---|---|---|---|
| 102172 | 11/1916 | United Kingdom | 5/95 |

*Primary Examiner*—Alexander Grosz
*Attorney, Agent, or Firm*—Sandra M. Kotin

[57] ABSTRACT

A foldable baby bed for infants and very young children which can be used at the level of and attached to the bed of the parent or as a free standing unit. The legs of the baby bed can adjust to various heights and the front legs can be locked into a forward horizontal orientation so as to slide under the mattress of a conventional bed and form an extension of that bed permitting the baby to be near the parent so that the parent does not have to get up or to bend over to reach for the baby. The baby bed has a flexible, detachable front wall which can be rolled down at the convenience of the parent making the baby's sleeping surface contiguous with that of the parent. The baby bed is portable and folds flat for storage or travel. A pocket attached to the side holds necessaries for the baby such as diapers and powder.

16 Claims, 5 Drawing Sheets

EXTEND-A-BED FOR INFANTS AND VERY YOUNG CHILDREN

FIELD OF THE INVENTION

The instant invention relates to a bed for infants and very young children which can be used at the level of and attached to the bed of the parent or as a free standing unit. The bed is easily folded flat for storage or travel.

BACKGROUND OF THE INVENTION

Many types of portable cribs and baby beds have come on the market in recent years. Some of them can be used as playpens as well as beds for babies and very young children. U.S. Pat. Nos. 4,635,305; 4,899,496; 4,750,223; 4,692,953; and 4,819,285 are some examples. Most of these are very low, resting on the floor or only a few inches above the floor. U.S. Pat. No. 4,819,284 shows an inflatable crib that is very lightweight and sits directly on the floor. All of these require the parent to bend over to take the baby out of the bed or crib.

None of the baby beds currently available are at the level of a regular bed. This means that even if the baby bed is pulled up next to the parents' bed, the parent must get up out of bed to reach the baby.

U.S. Pat. No. 4,232,413 shows a device for use as a cot in the rear seat of a car that essentially extends the level of the seat to form the bed. Somewhat the same idea is expressed in U.S. Pat. No. 4,005,898 for use in flat bed trucks.

The instant invention is a baby bed that is portable, lightweight, can be folded, and is used at the level of the parent's bed, to extend that bed to accomodate the infant or very young child.

SUMMARY OF THE INVENTION

From earliest times new mothers have used cradles and the like for their new born babies. In more recent times bassinets and portable cribs have been utilized, especially when the new mother wants her baby to be nearby or to sleep in the parent's room. This is particularly important for nursing mothers when they are alone with the baby so that they do not have to go into another room each time they have to feed the baby. The one problem with all of these forms of baby bed is that the mother has to get out of bed and bend over to reach the baby. This can be difficult if the mother is not feeling well, and especially difficult if the mother had delivered by caesarian section.

To avoid having to get up out of bed to get the baby, many mothers take the infant in bed with them, putting the baby in danger of falling off the bed and being injured if the mother falls asleep. A sleeping parent can also roll over the baby causing suffocation or other serious injuries.

There is a school of thought that babies should sleep with the parents until they are two or three years old or sometimes older. This is a custom practiced in many cultures and advocated in the United States by some pediatricians, child psychologists and parent groups. Articles in favor of the practice have appeared in recent publications for new parents (see for example "Mothering" No. 62, Winter 1992, 45–51) and have been the subject of several television talk show discussions. In all of the instances of the infant or very young child sleeping in bed with the parent there is still the possibility of injury to the child. When both parents are in the bed that danger is compounded.

It is an object of the present invention to provide a bed for the newborn or young child that is adjacent to, at the same level of, and connected to the parent's bed.

It is a further object of the present invention to provide a soft, movable partition to separate the baby's sleeping area from that of the parent so that the baby cannot roll onto the parent's bed and the parent cannot roll over and injure the baby. This partition is easily unfastened and folded down when the mother wants to reach for the baby. There is no need for the mother to bend over or to get out of bed. Pockets can be attached to the sides of the baby bed to hold diapers and other necessaries.

A still further object of the present invention is that the baby bed fold easily so that it can be moved or stored.

Another object of the present invention is to have the baby bed held in place safely and securely. This is accomplished by having the front leg assembly of the baby bed extend forward to the horizontal position and slide between the mattress and box spring of any regular bed. An adjustable rear leg assembly allows the baby bed to be at the right level regardless of the height of the larger bed.

Another object of the present invention is to have the front leg assembly capable of also being placed in the normal vertical position so that the baby bed can stand on its own and be used as a separate unit.

The instant invention is meant to be used as sleeping area for a baby. It is not designed for use as a playpen or to contain a young child. The sides are lower than those for the conventional crib and, after a certain age, the young child could easily climb out. It may, however, be used for a young child if under close supervision, or when traveling, since the child is right next to the parent and can be comforted when in strange surroundings.

The present invention consists of a rigid, flat, rectangular sleeping surface surrounded by three fixed walls and one flexible movable wall. The fixed walls are made of a rigid material which forms the frame to which is fastened strong, woven mesh or other cloth. The flexible movable wall is made of the same mesh or cloth, but has zippers and snaps at the two ends. These zippers and snaps integrate with zipper and snap components attached to the two adjacent fixed walls. The sleeping surface is supported by a rigid frame to which the back fixed wall is hingedly connected, as well as two adjustable leg assemblies. The lower margin of the flexible movable wall is permanently attached to the frame so that the baby cannot slip through when that wall is in place. A waterproof mattress is provided with the baby bed to soften the sleeping surface.

DETAILED DESCRIPTION OF THE INVENTION

The preferred embodiment of the present invention can be seen in the accompanying drawings.

Figure 2:
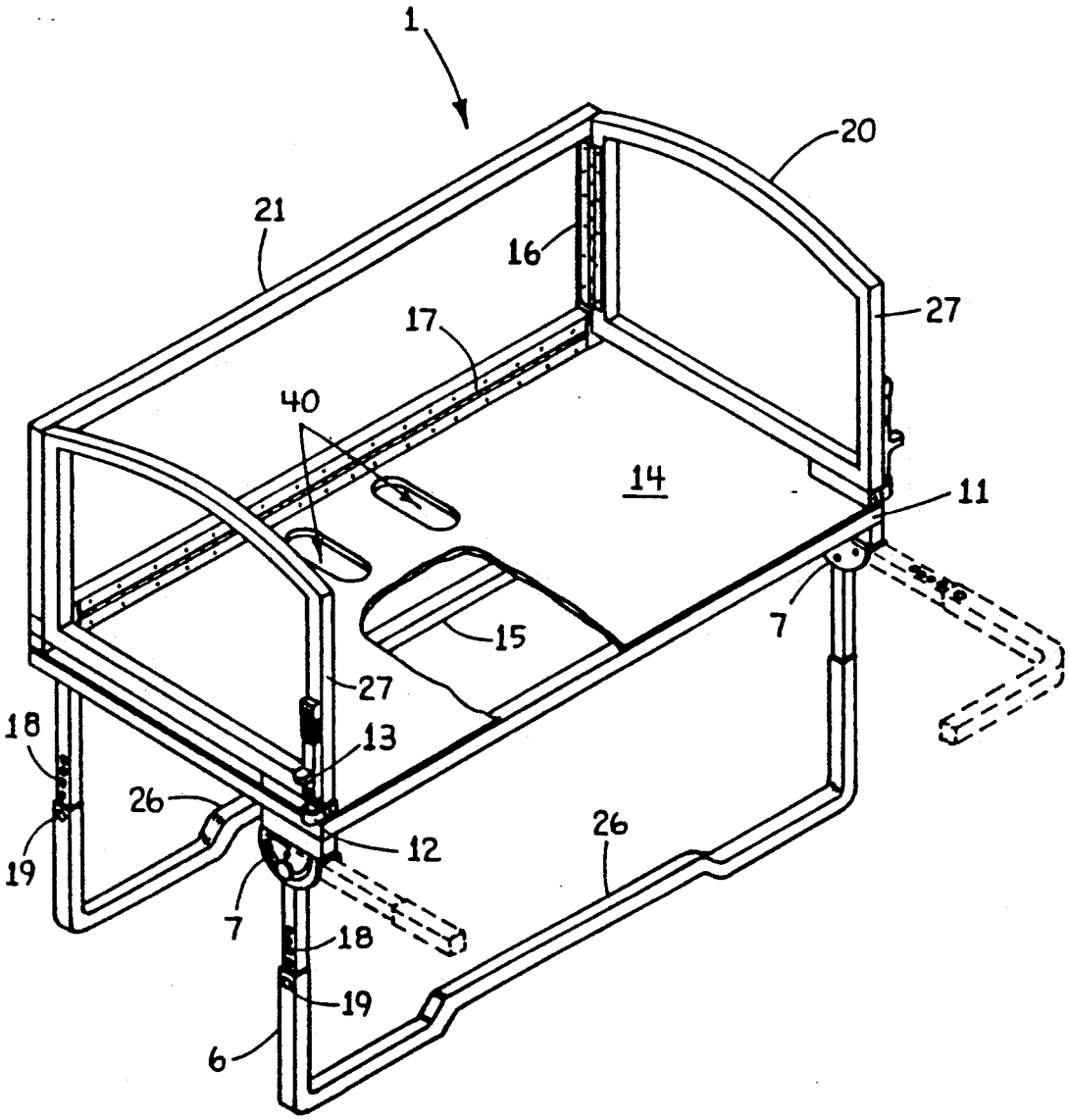
FIG. 2 is a perspective view of the frame structure of the present invention with the front leg assembly in the vertical or downward support position and the base plate partially cut away.

The baby bed 1 is constructed of a rigid frame as seen in FIG. 2 which can be made of metal, wood or a polymeric material. Ideally the framework is constructed of tubular steel, aluminum or polymeric material. The base 11 is rectangular with a reinforcing support strut 15 along its length, integral with the two sides of the base 11 and centered thereon. The sleeping area is defined by a back wall 21 connected to the base 11 by a hinge 17 and two side walls 20 which are not affixed to the base 11. The side walls 20 are affixed to either ends of the back wall 21 by hinges 16. The baby bed 1 is supported on a back leg assembly 5 hingedly attached to the underside of the base 11 at both ends of the back edge, and a front leg assembly 6 attached to the underside of the base 11 at both ends of the front edge by a unique three-position lock 7.

The front and back leg assemblies 5 and 6 each consist of two leg members having a plurality of openings 18 along the outside surface and which are fitted into the ends of a hollow a U-shaped connecting strut with a slightly raised center portion 26. Each end of the strut is fitted with a spring-set pin 19 which locks into one of the openings 18 in the leg member to hold the strut in place. Additionally, it is the spring-set pins 19 that allow the height of the leg assemblies to be changed and thus to adjust the baby bed to the desired height.

Figure 1:
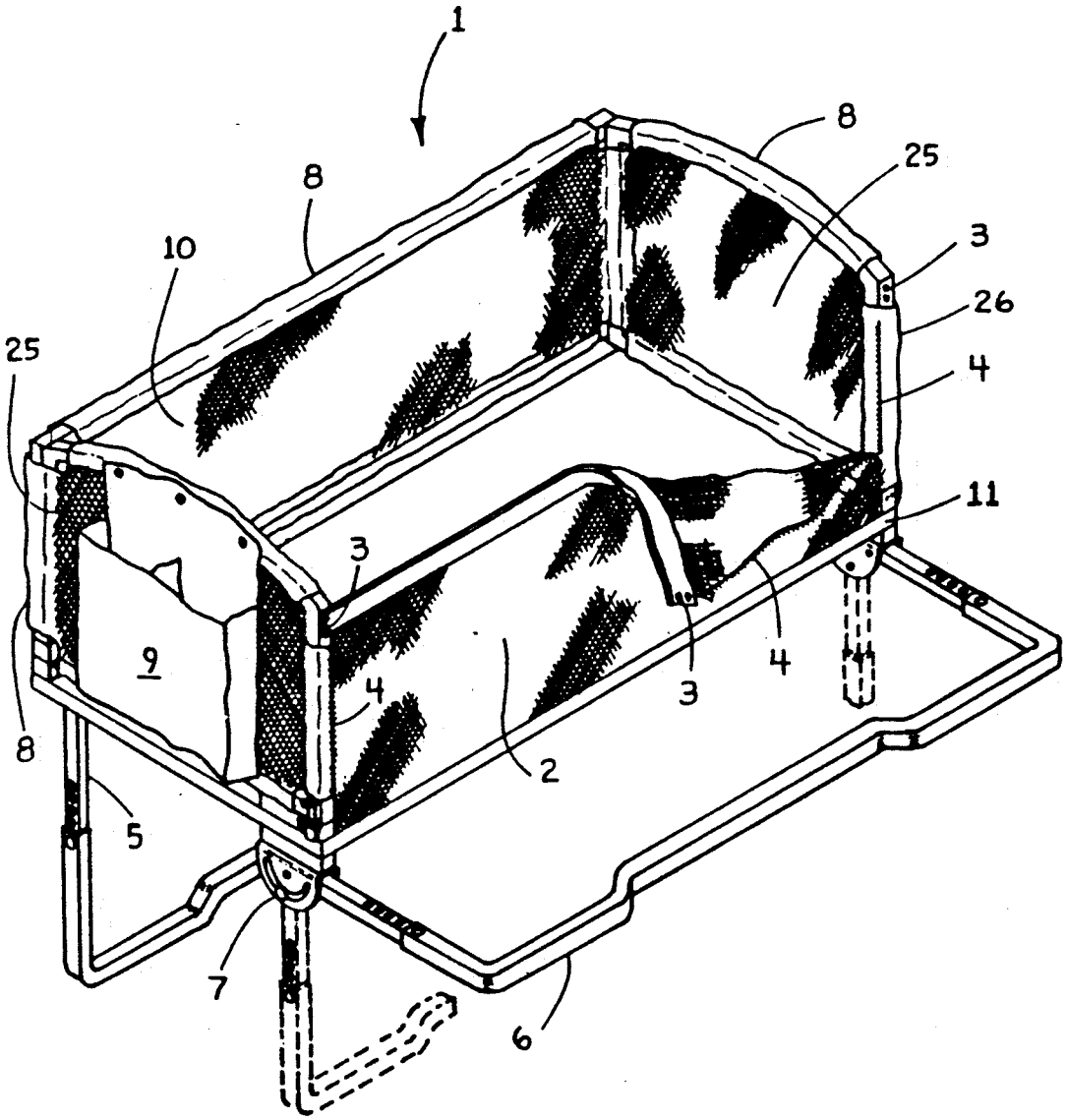
FIG. 1 is a perspective view of the preferred embodiment of the present invention with the front flexible wall partially turned down and the front leg assembly in the extended forward horizontal position.

The frame walls are covered with fabric panels. The fabric may be a mesh, net or other type of fabric. The back and side wall panels 10 and 25 are fitted to the frame by stitched sleeves 8. The sleeves may be made of the same mesh or they may be constructed of a sturdy fabric into which mesh panels are sewn. The front wall panel 2 is not fitted to a rigid frame, but remains flexible. It has one half of a zipper 4 and reinforcing snaps 3 affixed at each side. The other half of each zipper 4 is affixed to the sleeves 26 mounted on the front edges of the two side wall panels and the snaps are mounted on the upper front edges of the side wall frames 27. This permits the front wall 2 to be separated from the adjoining walls and rolled or folded down and out of the way when the mother wishes to tend the baby. The front wall 2 can be seen partially folded in FIG. 1.

Figure 3:
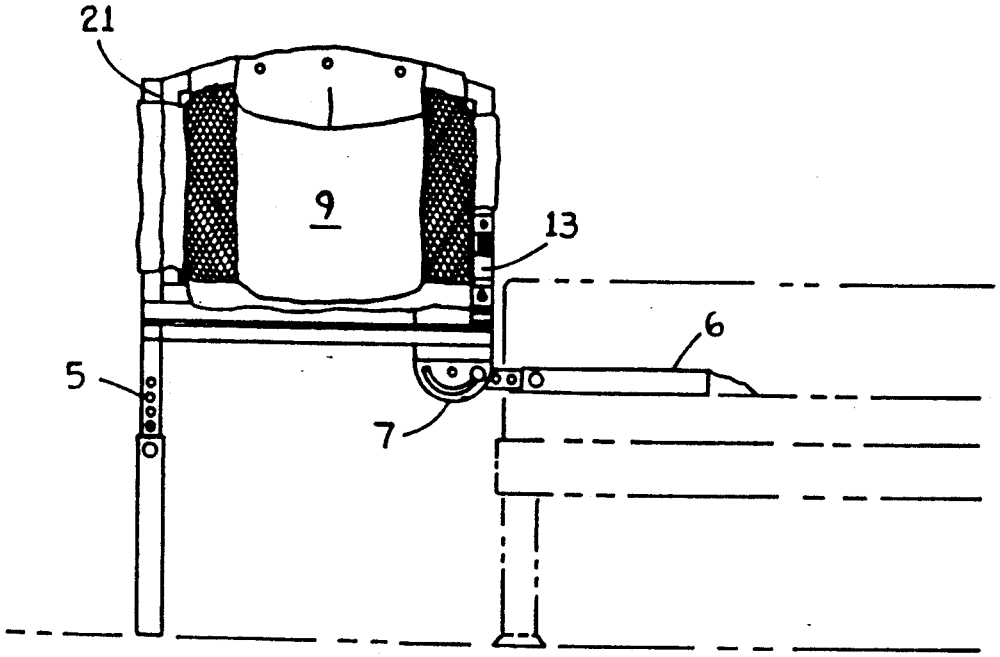
FIG. 3 is a side view of the present invention showing the front leg assembly in the extended forward position and inserted under the mattress of a conventional bed.
Figure 5:
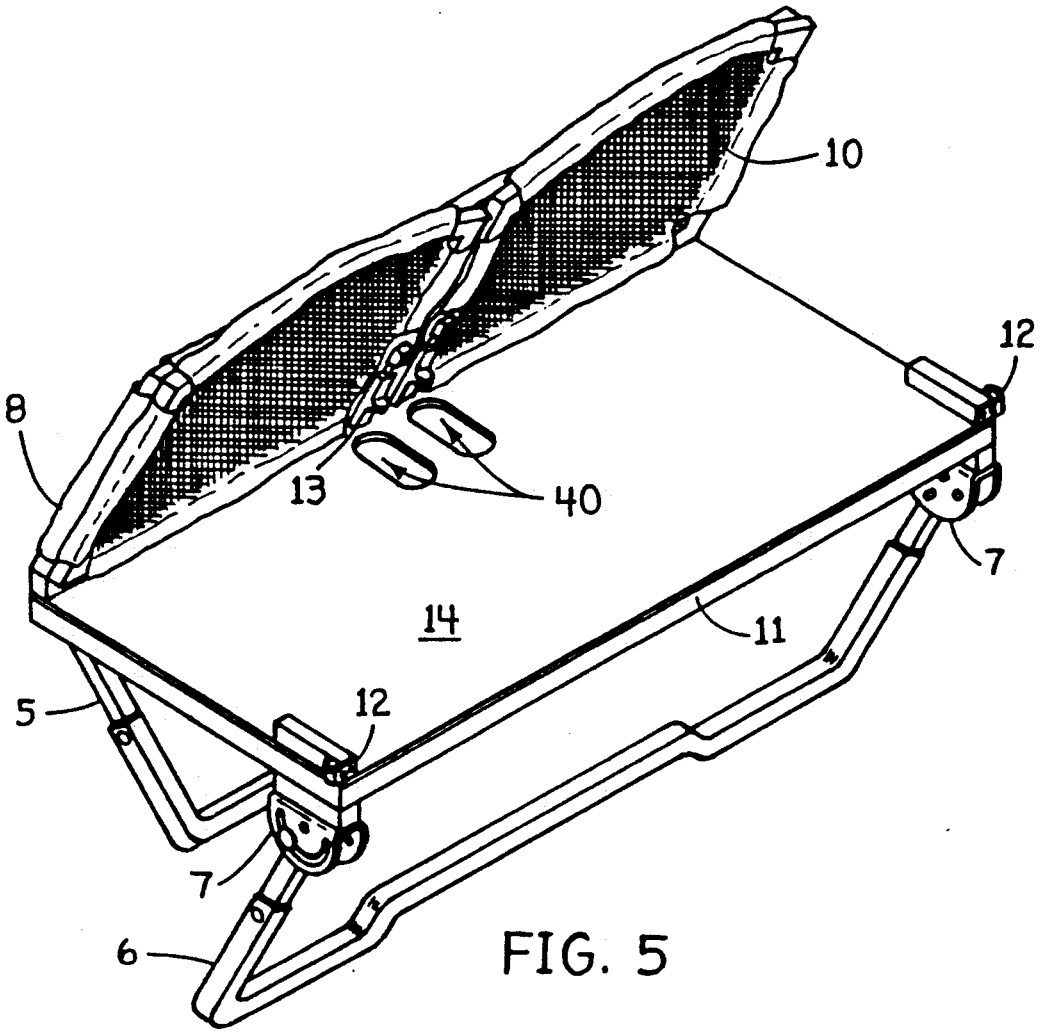
FIG. 5 is a perspective view without the flexible front wall showing the side walls completely folded and the front and back leg assemblies in the retracted positions and partially folded.
Figure 6:
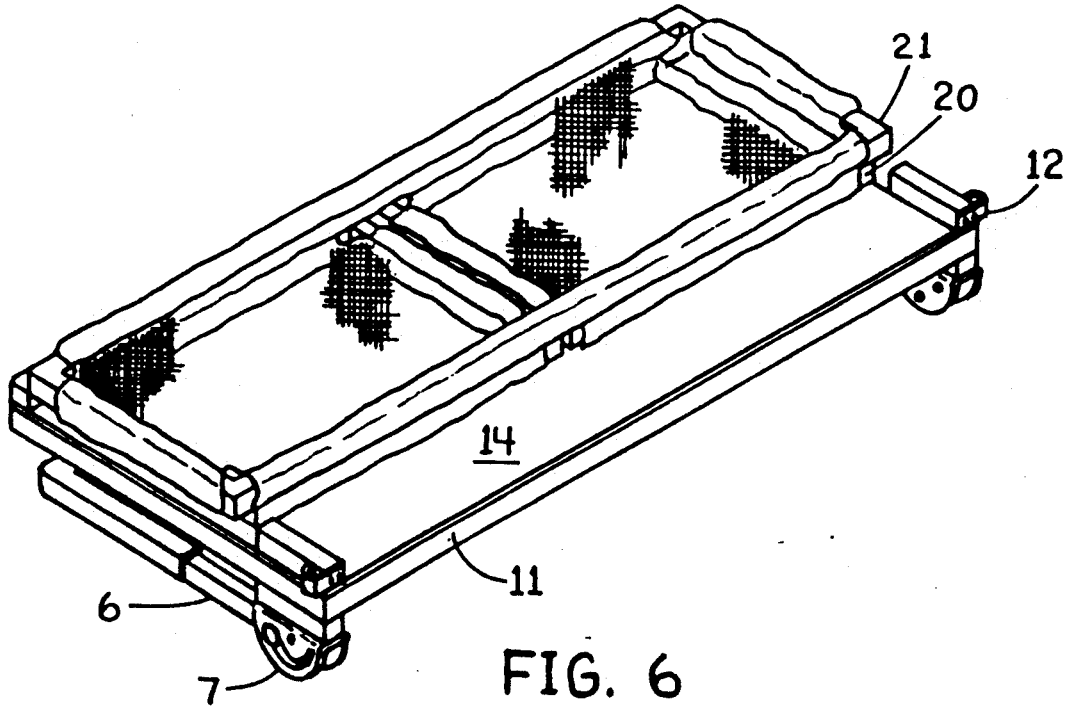
FIG. 6 is a perspective view without the flexible front wall and with all hinged parts completely folded.

The front and back leg assemblies 6 and 5 are alike, but they are not connected to the base 11 in the same way and they do not function in the same way. The back leg assembly 5 can be in the vertical or downward position (FIG. 1 and FIG. 2.) or it can be folded under the baby bed (FIG. 5 and FIG. 6) for storage or travel. It is attached to the base frame 11 by means of a two position locking hinge. Such hinges are well known in the art. The front leg assembly 6 can be fixed in any of three positions. The vertical or downward position (FIG. 2) is used when the baby bed is to stand alone, the extended or horizontal position (FIG. 1 and FIG. 3) is used when it is desired to have the baby bed coupled to the parent's bed. The leg assembly may also be folded under the baby bed for storage or travel (FIG. 5 and FIG. 6). To accomplish the three positions a unique three-position locking hinge 7 is used.

Figure 7:
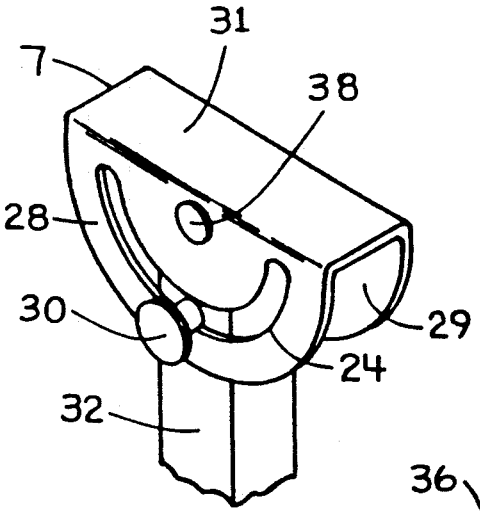
FIG. 7 is an enlarged perspective view of the front of the three-position locking hinge for the front leg assembly.
Figure 8:
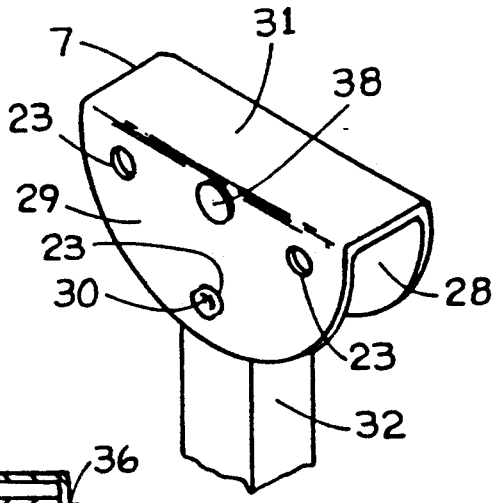
FIG. 8 is an enlarged perspective view of the back of the three-position locking hinge for the front leg assembly.
Figure 9:
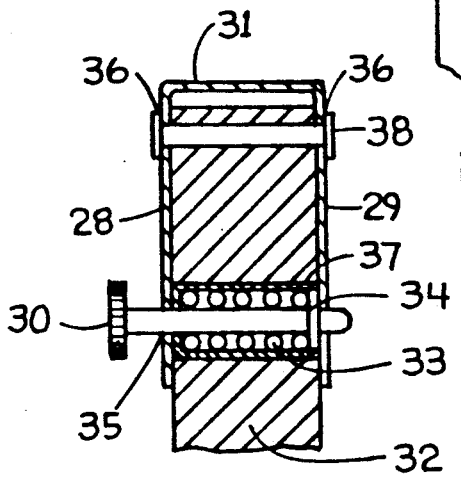
FIG. 9 is an enlarged view of a cross section of the three-position hinge with the leg member in place and showing the locking pin in a fixed position.

The three-position locking hinge 7 is illustrated in FIGS. 7, 8 and 9. The hinge 7 consists of a three surface housing 31 with a series of strategically placed openings, and a locking pin 30. The front face 28 and back face 29 are semicircular and the top surface is rectangular. The front face 28 contains a semicircular slot 24 adjacent to its lower edge and a small circular opening centered near the top. A screw or rivet 38 is fastened through this opening and through the leg member 32 resting within the housing 31, uniting the two. The back face 29 of the housing 31 contains three small circular openings 23 at 90 degree separations, corresponding to the two ends and the center positions of slot 24 in the front face 28 of the housing 31; and a small circular opening centered near the top, also corresponding to the one in the front face 28 of the housing 31. A locking pin 30 is fitted through slot 24 in the front face 28 of the housing 31, then through an opening 35 in the leg member 32 and out through one of the three openings 23 in the back face 29 of the housing 31. Positioned about the locking pin 30 inside opening 35 is a coil spring 33 surrounded by a spring housing 37; and permanently affixed to the locking pin 30 a short distance from the back end but within the housing 35 is a washer 34.

To change the attitude of the front leg assembly 6 the user only has to grasp the heads of locking pins 30 on each side of the front leg assembly 6 and pull them forward until the pins 30 are free of the back face 29 of the housing 31, move the front leg assembly 6 to the new position (a change of either 90 or 180 degrees) and release the locking pins 30, making sure that the backs of the pins 30 extend through the desired opening 23 in the back face 29 of the housing 31. The front leg assembly 6 will now be locked in the new position.

Figure 4:
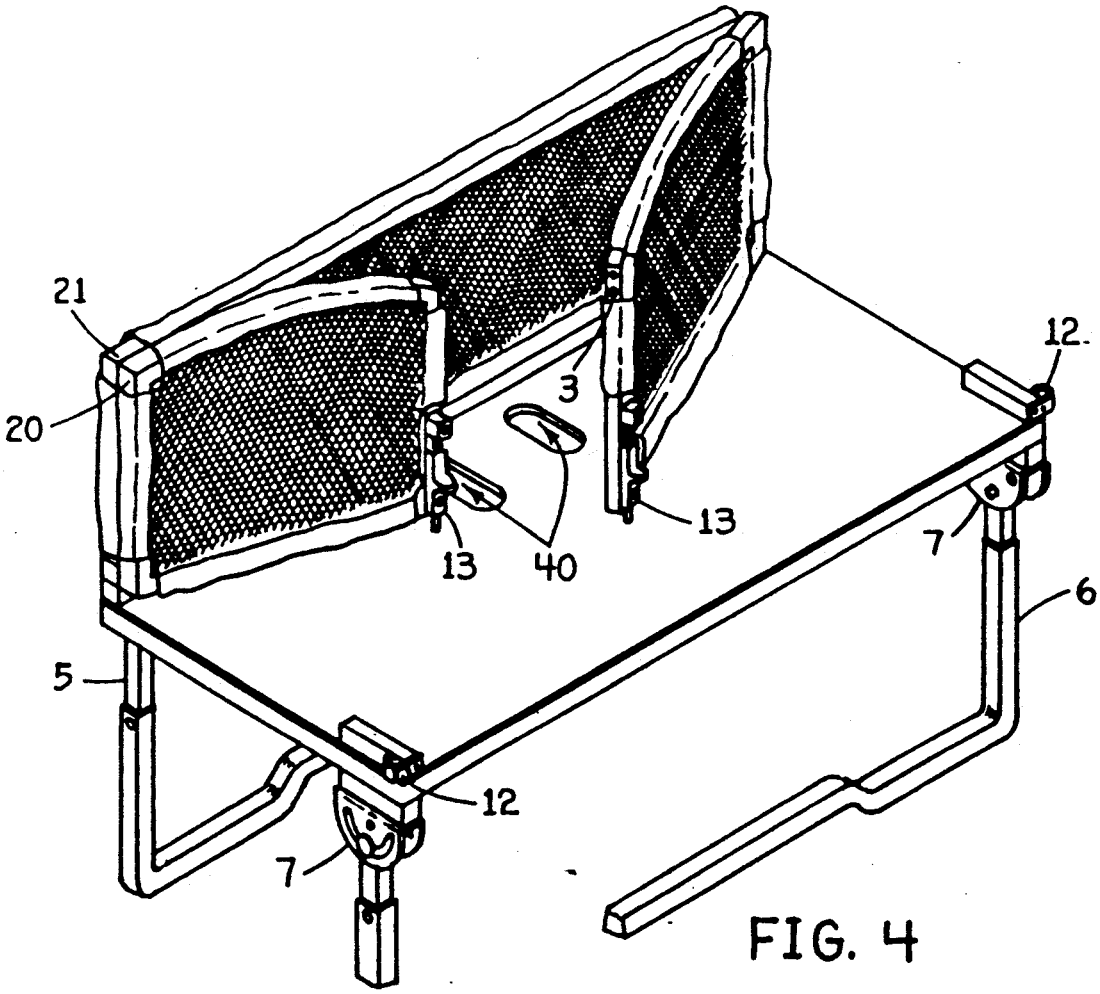
FIG. 4 is a perspective view without the flexible front wall and with the side walls partially folded.
Figure 10:
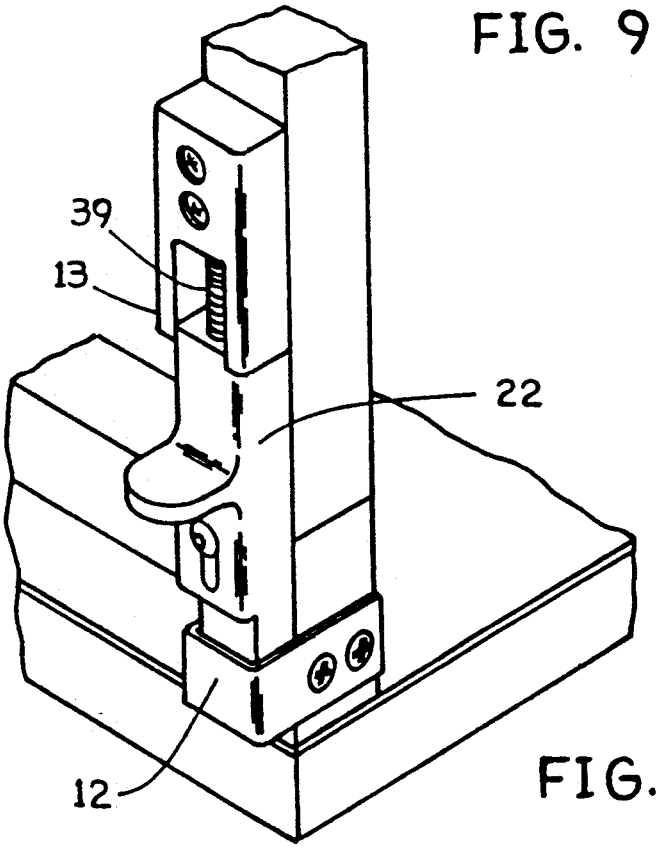
FIG. 10 is an enlarged perspective view of the side wall spring latch in place in the latch receptacle.

The two side walls 25 of the baby bed 1 are hinged along the back vertical edge to fold inward and are therefore not attached to the frame base 11. There is a spring latch 13 on the lower end of the front edge 27 of each side wall frame 20 (FIG. 10). The base frame 11 is fitted with a latch receptacle 12 at each side of the front edge. When the baby bed is in use the spring latch 13 is engaged with the latch receptacle 12 and the side walls 25 are locked in place. (See FIGS. 1, 2 and 3). When the user wishes to fold the baby bed 1 she needs only to lift the spring latch 13 by lifting on ledge 22, compressing the spring 39 and moving side walls 25 inward. (See FIGS. 4 and 5).

A rigid base plate 14 rests on the frame base 11 and within the walls 20 and 21. There are two oblong apertures 40 in the base plate 14 which are located close to the back edge and run parallel to the sides. These apertures 40 (seen in FIG. 2) correspond to the position of the spring latches 13 on the side walls 20 when the bed is folded. The apertures 40 permit the sides to fold flat against the base plate 14 whereby the spring latches 13 rest within the apertures 40.

Once the side walls 25 have been folded flat against the back wall 21 that wall can be folded down and all form a single unit to rest flat against the base plate 14. The back wall 21 is fitted with a hinge 17 all along its lower length to facilitate the flat fold. The two side walls 25 are slighly shorter then the back wall 21 with the extra space at the bottom so as not to get in the way of the hinge 17 when the bed is folded. The shorter length also permits the side walls 25 to easily fold inward without scraping the base plate 14. A waterproof mattress, not shown in the drawings rests on the base plate 14 when the bed is in use. The thickness of the mattress insures that there is no space under the side walls 25 in which a baby may be caught or injured. The mattress is removed when the bed is folded.

A compartmented utility pocket 9 may be affixed to the outside of one or both of side walls 25 to hold various necessaries such as diapers and baby powder.

While one embodiment of the present invention has been illustrated and described in detail, it is to be understood that this invention is not limited thereto and may be otherwise practiced within the scope of the following claims.

We claim:

1. A foldable baby bed capable of standing alone and also for use as an extension of an adult bed comprising:

a rigid support frame having a rectangular base hingedly integtrated with the back wall of the baby bed, to which are hingedly integrated the two side walls, both of which do not extend completely to the base and which contain connecting means to secure said sides to the base, and said frame base having receptacles to accept said connecting means and hold same fixedly in place;

a rigid support strut centrally affixed to and integrated with the sides of the rectangular frame base;

a rigid plate fitted into said frame base and resting on said support strut which plate forms the sleeping surface;

two parallel oblong apertures in the said plate corresponding to the positions of the said connecting means and to receive said connecting means when the bed is folded;

flexible fabric wall panels affixed to the said three walls of the frame;

a fourth flexible fabric wall panel permanently affixed along the front edge of the said frame base characterising the front wall of the baby bed and being removably coupled to the two adjacent side walls;

means to couple the said flexible fabric front wall to the two adjacent side walls;

two adjustable support legs hingedly mounted to the back corners of the frame base and connected by means of a U-shaped strut having a slightly raised central portion, thus forming the back leg assembly, said back leg assembly being capable of being locked in the vertical position and of being folded under the base;

two adjustable support legs pivotally mounted at the front corners of the frame base and connected by means of a U-shaped strut having a slightly raised central portion thus forming the front leg assembly, said front leg assembly being capable of being locked in the vertical position, being folded under the base and also of attaining a forward horizontal attitude for insertion under the mattress of a conventional bed so as to affix the baby bed securely thereto; and means to adjust said leg assemblies to the desired height.

2. A foldable baby bed as in claim 1 wherein the flexible fabric wall panels are affixed to the three frame walls by means of sleeves formed from the flexible fabric.

3. A foldable baby bed as in claim 1 wherein the flexible fabric wall panels are made of a mesh fabric so as to let air circulate therethrough and through which the baby can be observed.

4. A foldable baby bed as in claim 3 wherein sleeves affixing the mesh fabric wall panels to the frame walls are formed of a stiff material into which the mesh panels have been sewn.

5. A foldable baby bed as in claim 1 wherein the means to removably couple the said flexible fabric front wall to the two adjacent side walls comprises a zipper and snaps.

6. A foldable baby bed as in claim 1 having a compartmented pocket affixed to the outside of one or both side walls to hold necessaries.

7. A foldable baby bed as in claim 1 having a removable waterproof mattress which rests on the rigid plate.

8. A foldable baby bed as in claim 1 wherein the frame is composed of wood.

9. A foldable baby bed as in claim 1 wherein the frame is composed of metal.

10. A foldable baby bed as in claim 1 wherein the frame is composed of polymeric material.

11. A foldable baby bed as in claim 1 wherein the connecting means to secure the sides to the base is a spring latch.

12. A foldable baby bed as in claim 1 wherein the means to adjust the height of the leg assemblies comprises a plurality of small circular openings along the outside surface of the leg members and a movable spring-set pin within the strut member capable of engaging with and locking within the openings in said leg members.

13. A foldable baby bed as in claim 1 wherein the two adjustable back support legs are mounted to the frame base by means of two position locking hinges.

14. A foldable baby bed as in claim 1 wherein the means for pivotally mounting the two adjustable front support legs to the frame base comprises:

a rigid housing which fits over the top of each front support leg, said housing having semicircular front and back faces and a rectangular top surface, said front face having a semicircular slot along its lower edge and a circular opening centered near the top, and said back face having three circular openings 90 degrees apart along the lower edge and a circular opening centered near the top;

a rivet which passes through the centered opening in the front face, through a bore in the front support leg and through the centered opening in the back face thus binding the housing to the support leg;

a locking pin which passes through the slot in the front face, through a spring surrounded by a spring housing located in another bore in the front support leg, through an attached washer, and out through one of the three openings along the lower edge of the back face, thus locking the support leg in the desired orientation.

15. A baby bed comprising a sleeping surface having affixed thereto and being surrounded by three contiguous rigid walls, two side walls and a back wall, and a flexible front wall; also having affixed thereto, two front support legs and two back support legs; said front support legs capable of being oriented horizontally and forward for insertion under the mattress of a conventional bed for secure attachment of the baby bed thereto; and said flexible front wall being removably coupled along the lengths of the adjacent side walls such that said front wall can easily be rolled or folded down so as to make the sleeping surface contiguous with that of the conventional bed, and said front wall can just as easily be reposited.

16. A foldable baby bed comprising a rectangular sleeping surface having affixed thereto and being surrounded by three contiguous rigid walls, two side walls and a back wall, and a flexible front wall; two adjustable back support legs and two adjustable pivotally mounted front support legs capable of being oriented horizontally and forward for insertion under the mattress of a conventional bed so as to affix the baby bed thereto; and said flexible front wall being removably coupled along the lengths of the adjacent side walls such that said front wall can easily be rolled or folded down so as to make the sleeping surface contiguous with that of the conventional bed, and said front wall can just as easily be reposited.

* * * * *